US009364936B2

(12) United States Patent
Sreshta

(10) Patent No.: US 9,364,936 B2
(45) Date of Patent: Jun. 14, 2016

(54) DISPERSION OF HARDPHASE PARTICLES IN AN INFILTRANT

(75) Inventor: Harold A. Sreshta, Conroe, TX (US)

(73) Assignee: NATIONAL OILWELL DHT, L.P., Houston, TX (US)

( * ) Notice: Subject to any disclaimer, the term of this patent is extended or adjusted under 35 U.S.C. 154(b) by 703 days.

(21) Appl. No.: 13/271,415

(22) Filed: Oct. 12, 2011

(65) Prior Publication Data

US 2013/0092450 A1 Apr. 18, 2013

(51) Int. Cl.

| | |
|---|---|
| ***B22F 3/10*** | (2006.01) |
| ***B24D 3/06*** | (2006.01) |
| ***C22C 1/00*** | (2006.01) |
| ***E21B 10/43*** | (2006.01) |
| ***B24D 18/00*** | (2006.01) |
| ***B24D 99/00*** | (2010.01) |
| ***B22F 3/26*** | (2006.01) |
| ***C22C 29/08*** | (2006.01) |
| ***C22C 1/05*** | (2006.01) |
| ***C22C 1/10*** | (2006.01) |
| *B22F 5/00* | (2006.01) |

(52) U.S. Cl.

CPC ... *B24D 3/06* (2013.01); *B22F 3/26* (2013.01); *B24D 18/0009* (2013.01); *B24D 99/005* (2013.01); *C22C 1/00* (2013.01); *C22C 1/051* (2013.01); *C22C 1/1036* (2013.01); *C22C 29/08* (2013.01); *E21B 10/43* (2013.01); *B22F 2005/001* (2013.01)

(58) Field of Classification Search

None

See application file for complete search history.

(56) References Cited

U.S. PATENT DOCUMENTS

| | | | | |
|---|---|---|---|---|
| 3,149,411 | A | 9/1964 | Smiley | |
| 3,175,260 | A | 3/1965 | Bridwell | |
| 3,779,715 | A * | 12/1973 | Wendler et al. | 428/568 |
| 4,024,675 | A * | 5/1977 | Naidich et al. | 51/296 |
| 5,589,268 | A | 12/1996 | Kelley | |
| 5,733,664 | A * | 3/1998 | Kelley et al. | 428/457 |
| 6,045,750 | A | 4/2000 | Drake | |
| 6,287,360 | B1 | 9/2001 | Kembaiyan | |
| 6,663,688 | B2 * | 12/2003 | Findeisen et al. | 75/252 |
| 6,682,580 | B2 * | 1/2004 | Findeisen et al. | 75/236 |
| 6,984,454 | B2 | 1/2006 | Majagi | |
| 7,475,743 | B2 * | 1/2009 | Liang et al. | 175/374 |

(Continued)

FOREIGN PATENT DOCUMENTS

| | | |
|---|---|---|
| CA | 2852007 A1 | 10/2012 |
| GB | 1265743 A | 3/1972 |
| WO | 9954075 | 10/1999 |

(Continued)

OTHER PUBLICATIONS

Merriam-Webster, Dictionary Definition of Uniform, http://www.merriam-webster.com/dictionary/uniform, accessed Sep. 2, 2015.*

(Continued)

*Primary Examiner* — Humera Sheikh
*Assistant Examiner* — Seth Dumbris
(74) *Attorney, Agent, or Firm* — Conley Rose, P.C.

(57) ABSTRACT

Composite materials for use with a drill bit for drilling a borehole in earthen formations. The composite material comprises a first pre-infiltrated hardphase constituent and a second pre-infiltrated hardphase constituent. The second pre-infiltrated hardphase constituent is a carbide which comprises at least 0.5 weight % of a binder and at least about 1% porosity. The composite material further comprises an infiltrant.

25 Claims, 10 Drawing Sheets

(56) References Cited

U.S. PATENT DOCUMENTS

| | | | | |
|---|---|---|---|---|
| 2004/0234820 | A1 | 11/2004 | Majagi | |
| 2010/0038147 | A1* | 2/2010 | Lockstedt et al. | 175/426 |
| 2010/0276208 | A1 | 11/2010 | Sue | |
| 2011/0031028 | A1* | 2/2011 | Sreshta et al. | 175/425 |
| 2011/0120781 | A1* | 5/2011 | Lockwood et al. | 175/425 |

FOREIGN PATENT DOCUMENTS

| | | | |
|---|---|---|---|
| WO | 2008/129237 | A1 | 10/2008 |
| WO | 2010/049724 | A2 | 5/2010 |

OTHER PUBLICATIONS

International Preliminary Report on Patentability for PCT/US2012/059490 dated Apr. 15, 2014 (9 pages).

* cited by examiner

DISPERSION OF HARDPHASE PARTICLES IN AN INFILTRANT

BACKGROUND

1. Field of the Invention

The invention relates generally to earth-boring drill bits used to drill a borehole for the ultimate recovery of oil, gas, or minerals. More particularly, the invention relates to improved, longer-lasting matrix and impregnated bit bodies. Still more particularly, the present invention relates to providing composite hard particle matrix materials with improved erosion resistance.

2. Background of the Invention

An earth-boring drill bit is typically mounted on the lower end of a drill string and is rotated by rotating the drill string at the surface or by actuation of downhole motors or turbines, or by both methods. With weight applied to the drill string, the rotating drill bit engages the earthen formation and proceeds to form a borehole along a predetermined path toward a target zone. The borehole thus created will have a diameter generally equal to the diameter or "gage" of the drill bit.

The cost of drilling a borehole for recovery of hydrocarbons is very high, and is proportional to the length of time it takes to drill to the desired depth and location. The time required to drill the well, in turn, is affected by the number of times the drill bit must be changed before reaching the targeted formation. This is the case because each time the bit is changed, the entire string of drill pipe, which may be miles long, must be retrieved from the borehole, section by section. Once the drill string has been retrieved and the new bit installed, the bit must be lowered to the bottom of the borehole on the drill string, which again must be constructed section by section. This process, known as a "trip" of the drill string, requires considerable time, effort and expense. Accordingly, it is desirable to employ drill bits which will drill faster and longer. The length of time that a drill bit may be employed before it must be changed depends upon a variety of factors, including the bit's rate of penetration ("ROP"), as well as its durability or ability to maintain a high or acceptable ROP. In turn, ROP and durability are dependent upon a number of factors, including the ability of the bit body to resist abrasion, erosion, and wear.

Bit performance is often limited by selective erosive damage to the bit body. Decreasing the erosive wear of bit bodies increases the footage per bit run and maintains the design intent of cutter exposure for optimal cutting, and hydraulic flow paths, and also reduces the propensity of lost cutters and junk in the hole.

Two predominant types of drill bits are roller cone bits and fixed cutter bits, also known as rotary drag bits. A common fixed cutter bit has a plurality of blades angularly spaced about the bit face. The blades generally project radially outward along the bit body and form flow channels there between. Further, cutter elements are typically mounted on the blades. The FC (fixed cutter) bit body may be formed from steel or from a composite material referred to as matrix.

To improve the erosion resistance of steel bit bodies, a protective hardfacing coating is often applied, where a harder or tougher material is applied to a base metal of the bit body. An example of a hardfacing is described in US 2010/0276208 A1; in which the maximum thickness of the hardphase of the protective coating is stated as limited to about 210 μm. Other thin coatings, typically less than about 0.500 μm, like HVOF (high velocity oxygen fuel) sprayed and electrolytic coatings with co-deposition of micron size hardphase, have also been used on FC steel bits to reduce erosive body wear. The effectiveness of a FC steel body bit in erosive applications is dependent on the coating integrity. Coating failure and exposure of the steel body can lead to accelerated erosive damage effecting bit performance and dull condition of bit.

The propensity of steel body bits to experience erosive damage when in service has been a primary reason for the use of FC matrix bits. Such matrix bit bodies typically are formed by integrally bonding or embedding a steel blank in a hard particulate (or hardphase) material volume, such as particles of WC (tungsten carbide), $WC/W_2C$ (cast carbide) or mixtures of both, and infiltrating the hardphase with a infiltrant binder (or infiltrant).

In fabricating such bit bodies, the cavity of a graphite mold is filled with a hardphase particulate material around a preformed steel blank positioned in the mold. The mold is then vibrated to increase the packing of the hardphase particles in the mold cavity. An infiltrant, such as a copper alloy is melted, and the hardphase particulate material is infiltrated with the molten alloy. The mold is cooled and solidifies the infiltrant, forming a composite matrix material, within which the steel blank is integrally bonded. The composite matrix bit body is removed from the mold and secured to a steel shank having a threaded end adapter to mate with the end of the drill string. PDC (Polycrystalline Diamond Compact) cutters are then bonded to the face of the bit in pockets that were cast.

PDC matrix bit bodies suffer from erosion during many drilling applications, and the damage to the blades and gage of such bits is often so extensive it cannot be repaired.

A conventional matrix body bit is typically comprised of hardphase particles of macrocrystalline WC or cast carbide of combinations thereof. The particle size distributions are typically optimized to provide high powder packing with tap densities of about 10.0 g/cc and hardphase particle size distributions typically range from 80 Mesh (177 μm) to 625 Mesh (20 μm). The maximum particle size used in a conventional hardphase is typically 180 μm with a typical average size of 50μ. The size of the particles make them prone to pullout in erosive applications, hence the matrix is prone to wear and erosive damage. A more erosion resistant material would therefore improve the dull condition of such bits, and allow longer runs, more runs per bit body, and improved repairability.

DuraShell™ is surface enhancement coating, developed to reduce erosion of matrix bits. The coating has a bi-modal hardphase distribution of large cast carbide particles of about 600 μm comprising about 65 wt % and 100 μm spherical cast carbide particles comprising about 35 wt %. A uniform distribution of hardphase constituents is produced by the use of a fugitive binder which typically comprises about 3 wt % of the hardphase mix. FIG. 1, depicts the position of erosion on a typical bit crown indicated by shaded areas, as such the mix is selectively applied to the corresponding areas on a mold surface (erosion resistant mix formulations can be applied to internal cavities within the bit, such as nozzle bores and to gage locations for erosion protection). The mold is then loaded with conventional hardphase powder and infiltrated with an alloy. The resultant bit body comprises selectively placed integral bonded surface enhancements, on the bit body where erosion is likely to occur.

FIG. 2 however, shows the microstructure of the integral bonded surface enhancement and exemplifies that the erosion resistance of the integral bonded surface enhancement is limited by preferential wear of the matrix binder due to its reduced hardness (typically about 125 VHN). The matrix therefore wears most quickly, exposing the hardphase particles leading to particle pull out and or cracking and fracturing of the surface. Therefore, there is a need to reduced the wear rate of the matrix and provide effective erosion resistance of such large particle surface enhancements.

Diamond shell surface enhancement coating, is another example of a surface enhancement developed with the aim of reducing erosion of matrix bits. The coating has a bi-modal hardphase distribution, comprising of about 15 wt % of 500 μm particles of diamond grit and about 85 wt % of macrocrystalline WC with an average particle size of about 50 μm. A uniform distribution of hardphase constituents is produced via the use of a fugitive binder which comprises about 3 wt % of the mix. The mix is selectively applied to areas of a mold surface where the bit body is prone to erosion. The mold is then loaded with a conventional hardphase powder and infiltrated with a Cu alloy. The resultant bit body comprises selectively placed diamond surface enhancements located on the bit body where erosion is likely to occur.

The diamond enhancement however, is limited by wear to the Cu alloy matrix binder (typical harness of 150 VHN) and subsequent pullout of the hardphase particles. Therefore it would be desirable to increase the hardness of the matrix, thereby reduce matrix wear rate and provide more effective erosion resistance of the large particle diamond surface enhancement.

The use of cemented carbide particles (for example WC-Co, WC-Ni, Metal-Carbide or combinations thereof) in composite matrix materials has typically been limited because when infiltrant interacts with the cemented carbide, a decrease in hardness of the resultant matrix is observed. The decrease in hardness is due in part to the increase in the mean free path of the hardphase after the cast body is cooled, and subsequent ease of pull out of the hardphase from the matrix.

The degradation of a commercially available matrix powder, (M2001 by Kennametal with MF53 copper alloy infiltrant) is shown in FIG. 3. The WC-Co cemented carbide particle had a pre-infiltration hardness of about 1300 VHN, which degraded to about 800 VHN on interaction with the infiltrant. FIG. 3, shows that the addition of a molten infiltrant to a dense hardphase of cemented hardphase particles results in a bloated hardphase within the matrix. The cemented hardphase particles post infiltration are typically 2 to 3 times larger in size than the cemented hardphase particles prior to infiltration.

Fixed-cutter bits comprised of infiltrated hardphase composites are further disclosed in U.S. Pat. Nos. 6,984,454, 3,149,411, 3,175,260, and 5,589,268. An example of a matrix composite using cemented carbide hardphase where degradation of the hard component was a concern is documented in U.S. Pat. No. 3,149,411. Infiltrant alloy chemistry was used to limit the degradation of the cemented carbide particles by using infiltrant alloys containing a metal from Group VIII, Series 4 of the Periodic Table (i.e., iron, cobalt or nickel) and minor amounts of chromium and boron.

Another example of a hardphase composite is documented in U.S. Pat. No. 3,175,260, where particles of cemented tungsten carbide or tungsten carbide alloy were heated and the molten matrix metal infiltrant poured into the mold containing the hard particles allowing the infiltrant to infiltrate the interstices of a mass of the hardphase. The melting point of the infiltrant ranged between about 1550° F. (843° C.) and 2400° F. (1316° C.) and decreasing the infiltration temperature and time was used as a method to suppress the interaction between the cemented carbide hardphase and the infiltrant during infiltration.

An example of selective placement of discrete inlays of hardphases with compositions that differ from the bulk material of the matrix body of a fixed cutter matrix bit are disclosed in U.S. Pat. No. 5,589,268 and U.S. Pat. No. 5,733,664. The art further discloses the fabrication of a composite comprising at least one discrete hardphase element held by a matrix powder wherein an infiltrant was infiltrated into the hard components.

One disclosed infiltrant was a copper-nickel-zinc alloy identified as MACROFIL 65, which has a melting point of about 1100° C. Another disclosed infiltrant was a copper-manganese-nickel-zinc-boron-silicon alloy identified as MACROFIL 53, having a melting point of about 1204° C. The art did not disclose a way to selectively use surface enhancements to increase erosion resistance.

U.S. Pat. No. 6,984,454 discloses a wear-resistant member that includes a hard composite member that is securely affixed to at least a portion of a support member. The hard composite is comprised of a plurality of hard components within a mold where an infiltrant alloy that has been infiltrated into the mass of the hard components.

The hard composite member disclosed in U.S. Pat. No. 6,984,454, consisted of multiple discrete hard constituents distributed in the composite member, the discrete hard constituents comprised one or more of: sintered cemented tungsten carbide, and a binder included one or more of cobalt, nickel, iron and molybdenum, coated sintered cemented tungsten carbide wherein a binder includes one or more of cobalt, nickel, iron and molybdenum, and the coating comprises one or more of nickel, cobalt, iron and molybdenum, and a matrix powder comprising hard particles wherein most of the hard particles of the matrix powder have a smaller size than the hard constituents. The infiltrant alloy employed had a melting point between about 500° C. to about 1400° C., and was infiltrated under heat into a mixture of the discrete hard constituents and the matrix powder so as to not effectively degrade the hard constituents upon infiltration. The hard constituents and the matrix powder and the infiltrant alloy were bonded together to form the hard composite member. However, degradation of the cemented carbide constituent was disclosed as an issue.

U.S. Pat. No. 6,045,750 discloses that a functional composite material for a steel bit roller cone body with erosion resistant wear surface enhancements can be achieved with high hardphase particle loading (high volume fraction), of about 75 volume %, and large constituent cemented carbide particle size by powder forging (solid state densification) cones The surface enhancement coating thickness in this case is limited in thickness to about three times the hardphase particle diameter and is constrained by the surface roughness or the texture of coating.

It is also known that powder-forged hard composite inlays, elements, or components with high cemented carbide loading and large constituent particles offer enhanced performance when used as cutting edges and wear surfaces in drill bits and other earth-engaging equipment. However, levels of achievable hard phase volume fractions are limited by geometric constraints on powder packing and by deformation/fracture behavior of particles during the forge cycle. In particular, coarse particle size fractions needed for maximizing packing density and wear resistance tend to bridge during forge densification, leading to voids and particle fracture defects in the densified composite. These problems are mitigated by formulation of powder preforms with at least one sintered cemented carbide particulate constituent of a composition, size, and residual porosity that imparts preferential plastic deformation and densification at forging temperature under local conditions of elevated pressure associated with particle contacts.

This functionality is provided by formulating a steel matrix of the hard composite using iron powder in the preform with a particle size less than 20 micrometers, in conjunction with the deformable partially porous sintered cemented carbide particulate constituent having a particle size that is between 5 to 100 micrometers. If the deformable sintered cemented carbide particulate constituent also has a nickel binder and another sintered cemented carbide hard phase constituent comprises a cobalt binder, useful strengthening of the matrix will be realized through the formation of tempered martensite halos around the cobalt binder carbide phase(s), due to nickel and cobalt diffusion and alloying of the surrounding iron matrix. The resulting hard composite microstructure exhibits increased resistance to the shear localization failure/wear progression [as disclosed in U.S. Pat. Appl. No. 2011/0031028 A1]. This publication, however is limited to steel body fixed cutter bit enhancements.

Hence, conventional FC composite materials that use large hardphase particle sizes to increase erosion resistance, often are limited by preferential matrix (binder) wear due to particle pullout and subsequent cracking and chipping damage to expose the primary large particles of the hard phase during service. Thus, a need exists for composite materials for use in bit body matrices and wear surfaces on drill bits and other earth-engaging equipment that provide surface enhancements with increased erosion resistance to improve bit performance in demanding downhole applications, thereby increasing bit footage/run, providing significantly better looking dulls, maintaining design intent of cutter exposure and hydraulic flow paths during the run and reducing risk of lost cutters in the hole.

As such, embodiments disclosed herein address the requirement for improved erosion resistance in composites used in bit body matrices and wear surfaces on drill bits and other earth-engaging equipment, as compared to certain conventional composites used and known in the art.

BRIEF SUMMARY OF THE DISCLOSED EMBODIMENTS

These and other needs in the art are addressed in one embodiment of the present invention by a composite material comprising: a first pre-infiltrated hardphase constituent; at least a second pre-infiltrated hardphase constituent. The second pre-infiltrated hardphase constituent is a porous carbide which comprises at least 0.5 weight % of a binder and at least about 1% porosity.

The composite material also comprises an infiltrant. In some embodiments the composite material further comprises a third pre-infiltrated hardphase constituent. In some embodiments of the composite material, the second pre-infiltrated hardphase constituent is a partially sintered cemented tungsten carbide. In other embodiments, the second pre-infiltrated hardphase constituent is 83WC-17Ni. In still further embodiments of the composite material, the second pre-infiltrated hardphase constituent comprises about 1% to about 5% porosity. In further embodiments of the composite material the infiltrant comprises at least one of Al, Co, Cr, Ni, Fe, Mg, Zn, and Cu.

In some embodiments a method of making a composite material comprises: mixing; a first pre-infiltrated hardphase constituent; a second pre-infiltrated hardphase constituent; and a fugitive binder to form a mixture. Loading the mixture into a coupon mold; and adding matrix powder to said mold; further adding infiltrant to said mold; superheating the infiltrant; and disintegrating the second pre-infiltrated hardphase constituent in the infiltrant, forming a dispersion of first pre-infiltrated hardphase and disintegrated second pre-infiltrated hardphase constituents within the binder infiltrant; and cooling the dispersion to form the composite material.

Other embodiments comprise a drill bit for drilling a borehole in earthen formations comprising: a bit body having a composite material. The composite material comprises; a first pre-infiltrated hardphase constituent; and a second pre-infiltrated hardphase constituent. The second pre-infiltrated hardphase constituent is a carbide which comprises at least 0.5 weight % of a binder and at least about 1% porosity. The composite material further comprises an infiltrant.

Thus, embodiments described herein comprise a combination of features and characteristics intended to address various shortcomings associated with certain prior drill bits, cutting elements, wear surfaces, hard particle matrix composites, and methods of using the same. The various features and characteristics described above, as well as others, will be readily apparent to those skilled in the art upon reading the following detailed description, and by referring to the accompanying drawings.

BRIEF DESCRIPTION OF THE DRAWINGS

For a detailed description of the disclosed embodiments of the invention, reference will now be made to the accompanying drawings, wherein.

DETAILED DESCRIPTION OF THE DISCLOSED EMBODIMENTS

Figure 1:
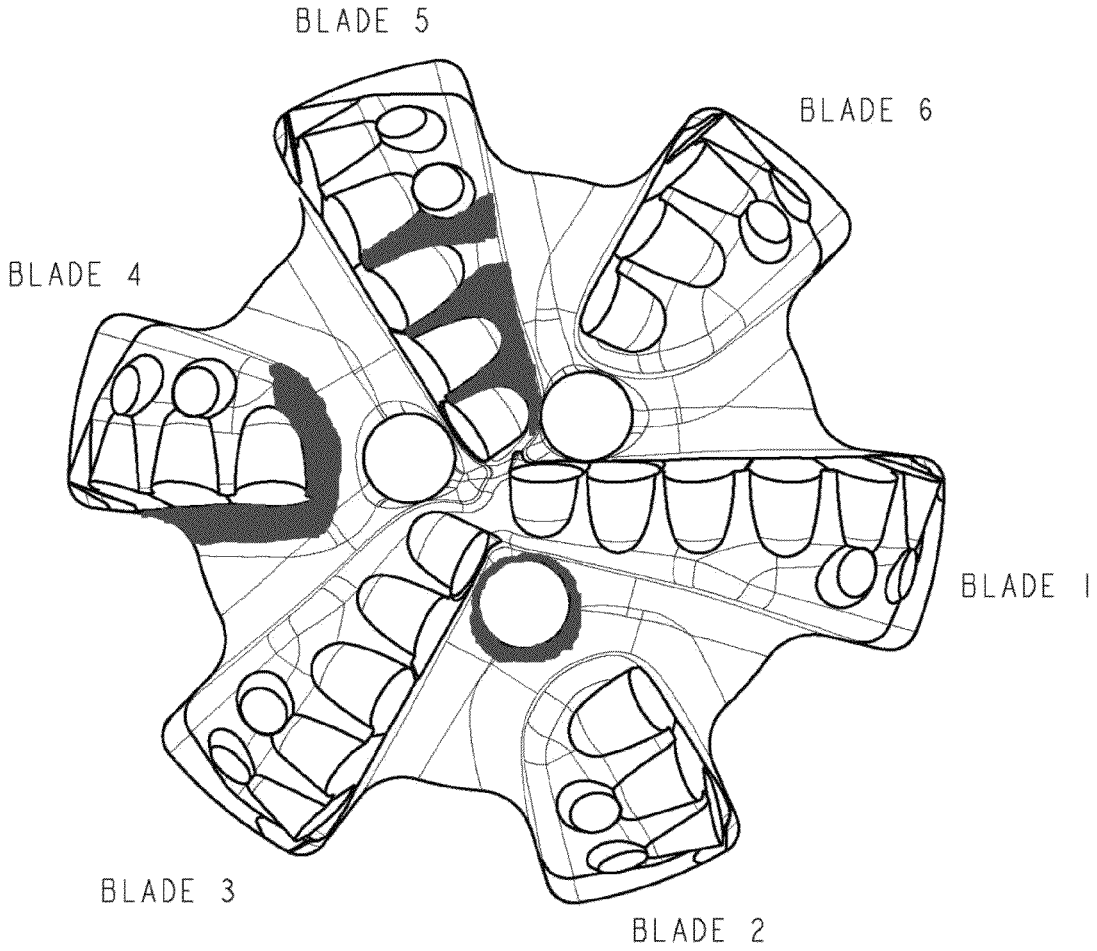
FIGURE 1 (Prior Art)
FIG. 1 depicts a perspective view of a bit crown.
Figure 2:
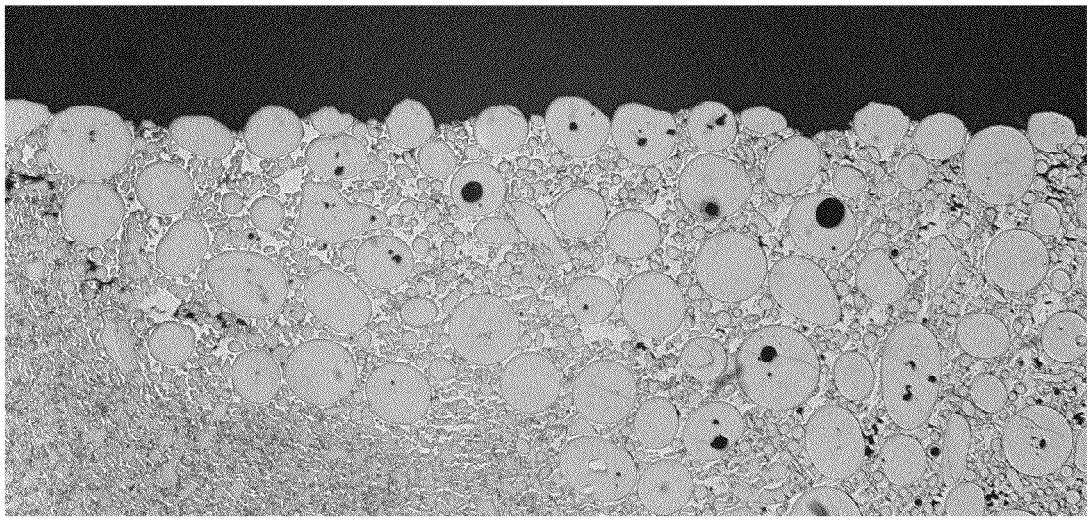
FIGURE 2 (Prior Art)
FIG. 2 depicts a micrograph of Durashell™ surface enhancement made in accordance with the prior art.
Figure 3:
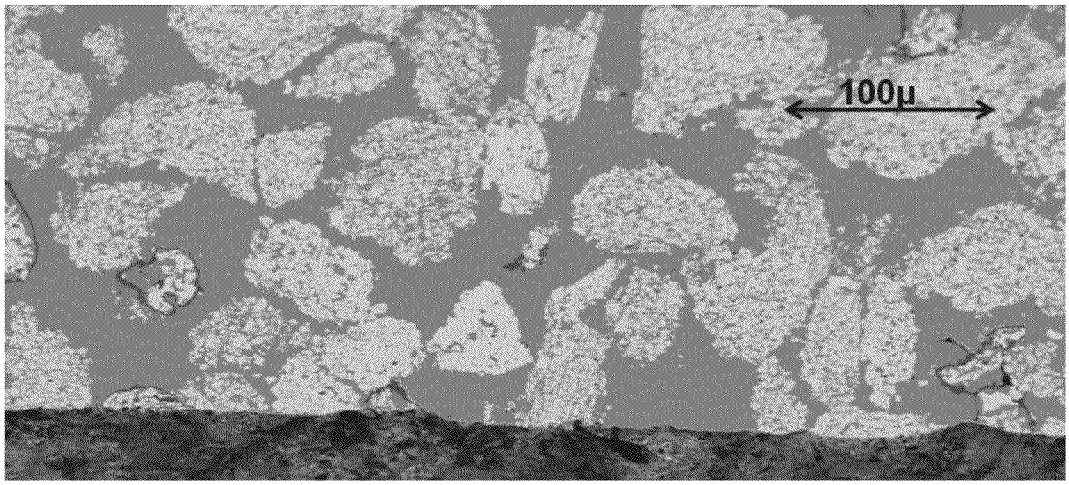
FIGURE 3 (Prior Art)
FIG. 3 depicts a light photo-micrographic image of M2001 hardphase matrix microstructure made in accordance with the prior art.

The following discussion is directed to various exemplary embodiments of the invention. However, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and that the scope of this disclosure, including the claims, is not limited to that embodiment.

The drawing figures are not necessarily to scale. Certain features and components herein may be shown exaggerated in scale or in somewhat schematic form and some details of conventional elements may be omitted in interest of clarity and conciseness.

In the following discussion and in the claims, the terms "including" and "comprising" are used in an open-ended fashion, and thus should be interpreted to mean "including, but not limited to . . . ." As used herein, the term "about," when used in conjunction with a percentage or other numerical amount, means plus or minus 10% of that percentage or other numerical amount. For example, the term "about 80%," would encompass 80% plus or minus 8%.

Further, throughout the following discussion and in the claims, herein a composite material maybe also described as a hardmetal composite material, a hardmetal matrix composite material, a hardmetal infiltrant composite material, a hard particle composite material, a hard particle matrix composite material, a hard particle matrix material, a hard particle infiltrant composite material, a hardphase composite material, a hardphase matrix composite material and a hardphase infiltrant composite material. Also, a matrix binder maybe referred to as a binder infiltrant or infiltrant. A matrix that is formed by the action of a molten matrix binder on hardmetal, hardphase or hard particle constituents may also be described as a matrix that is formed by the action of a molten binder infiltrant on hardmetal, hardphase or hard particle constituents.

Figure 4:
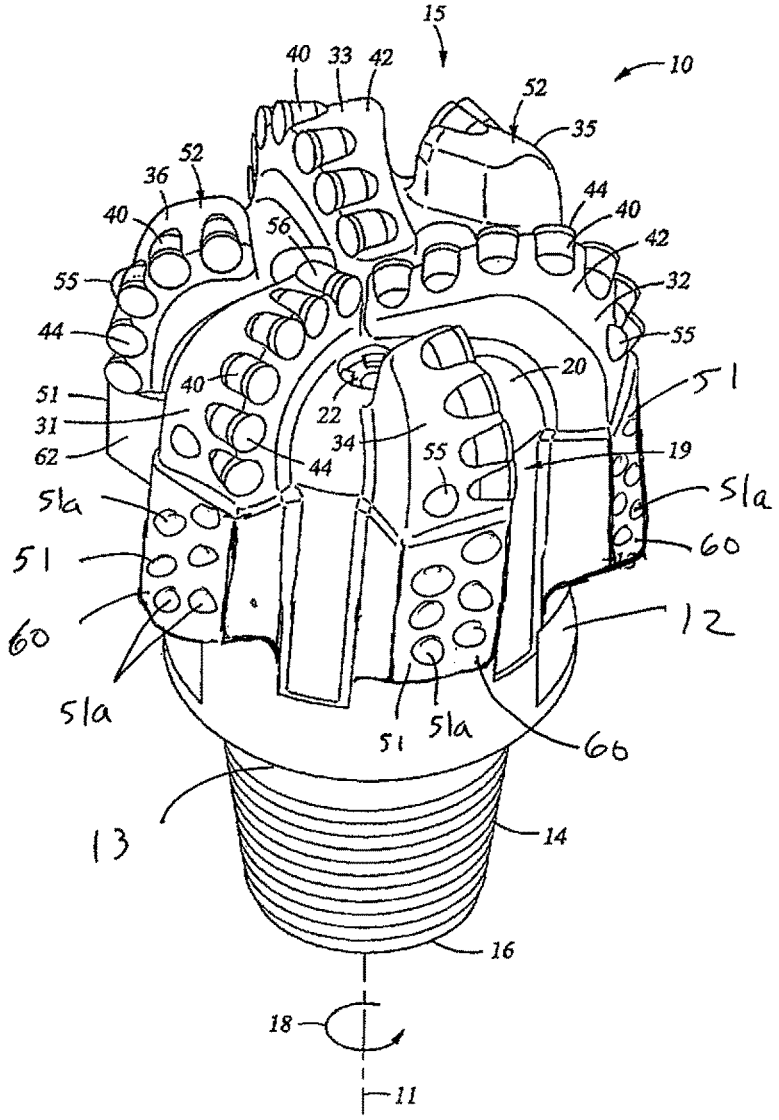
FIG. 4 is a perspective view of an embodiment of a bit made in accordance with principles described herein.
Figure 5:
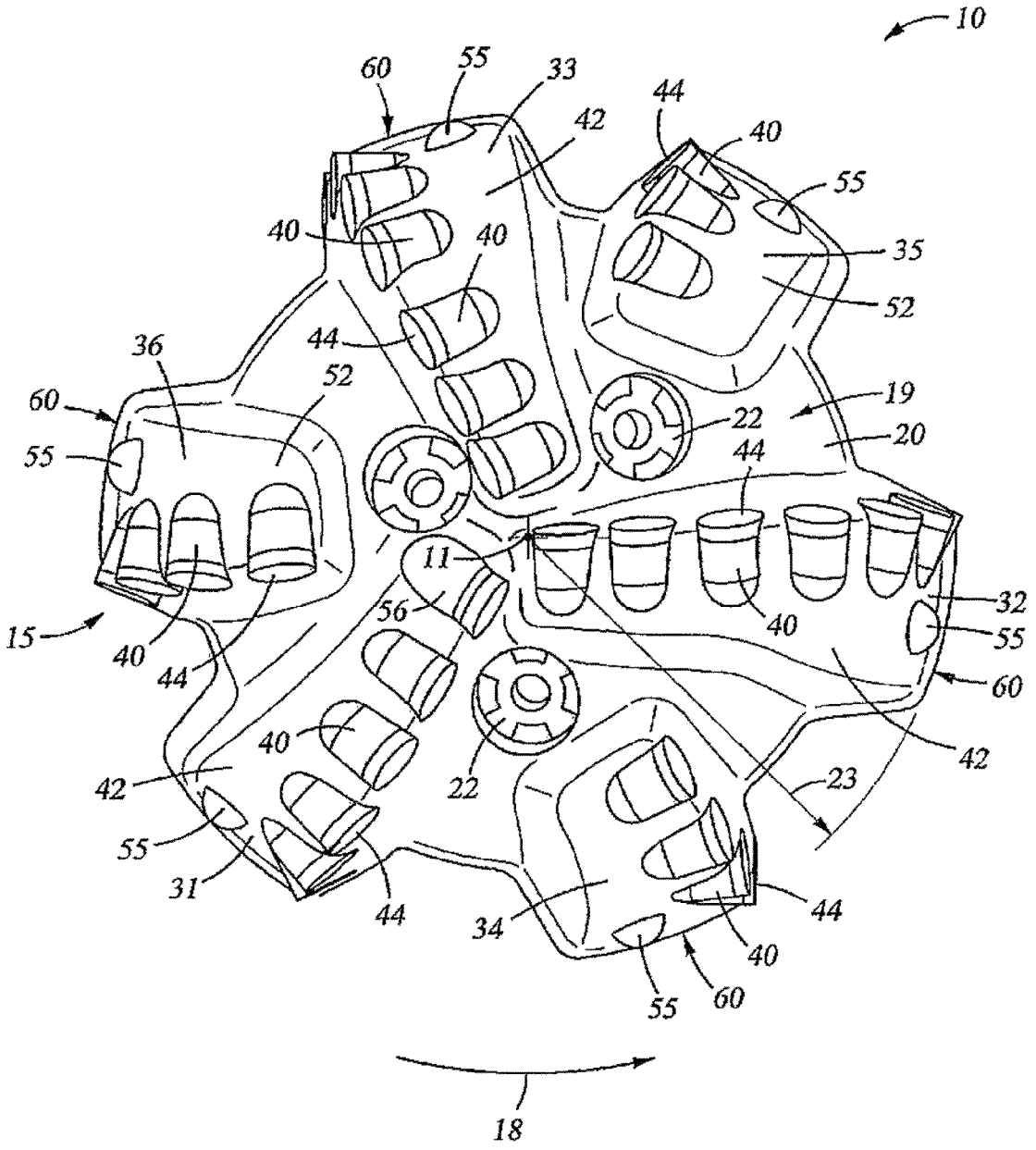
FIG. 5 is a top view of the bit shown in FIG. 4.

Referring to FIGS. 4 and 5, exemplary drill bit 10 is a fixed cutter PDC bit adapted for drilling through formations of rock to form a borehole. Bit 10 generally includes a bit body 12, a shank 13 attached to a threaded connection or pin 14 for connecting bit 10 to a drill string (not shown). Bit face 20 supports a cutting structure 15 and is formed on the end of the bit 10 that faces the formation and is generally opposite pin end 16. Bit 10 further includes a central axis 11 about which bit 10 rotates in the cutting direction represented by arrow 18.

Cutting structure 15 is provided on face 20 of bit 10 and includes a plurality of blades which extend from bit face 20. In the embodiment illustrated in FIGS. 4 and 5, cutting structure 15 includes six blades 31, 32, 33, 34, 35, and 36. In this embodiment, the blades are integrally formed as part of, and extend from, bit body 12 and bit face 20, and blades 31, 32, 33 and blades 34, 35, 36 are separated by drilling fluid flow courses 19. Referring still to FIGS. 4 and 5, each blade, includes a cutter-supporting surface 42 or 52 for mounting a plurality of cutter elements. Bit 10 further includes gage pads 51 of substantially equal axial length measured generally parallel to bit axis 11. Gage pads 51 are disposed about the circumference of bit 10 at angularly spaced locations. In this embodiment, gage pads 51 are integrally formed as part of the bit body 12.

Gage-facing surface 60 of gage pads 51 abut the sidewall of the borehole during drilling. The pads can help maintain the size of the borehole by a rubbing action when cutter elements 40 wear slightly under gage. Gage pads 51 also help stabilize bit 10 against vibration. In certain embodiments, gage pads 51 include flush-mounted or protruding cutter elements 51*a* embedded in gage pads to resist pad wear and assist in reaming the side wall. Cutter element 40 comprises a cutting face 44 attached to an elongated and generally cylindrical support member or substrate which is received and secured in a pocket formed in the surface of the blade to which it is fixed. Cutting face 44, in the embodiment shown, comprises a polycrystalline diamond material. In general, each cutter element may have any suitable size and geometry.

Figure 6:
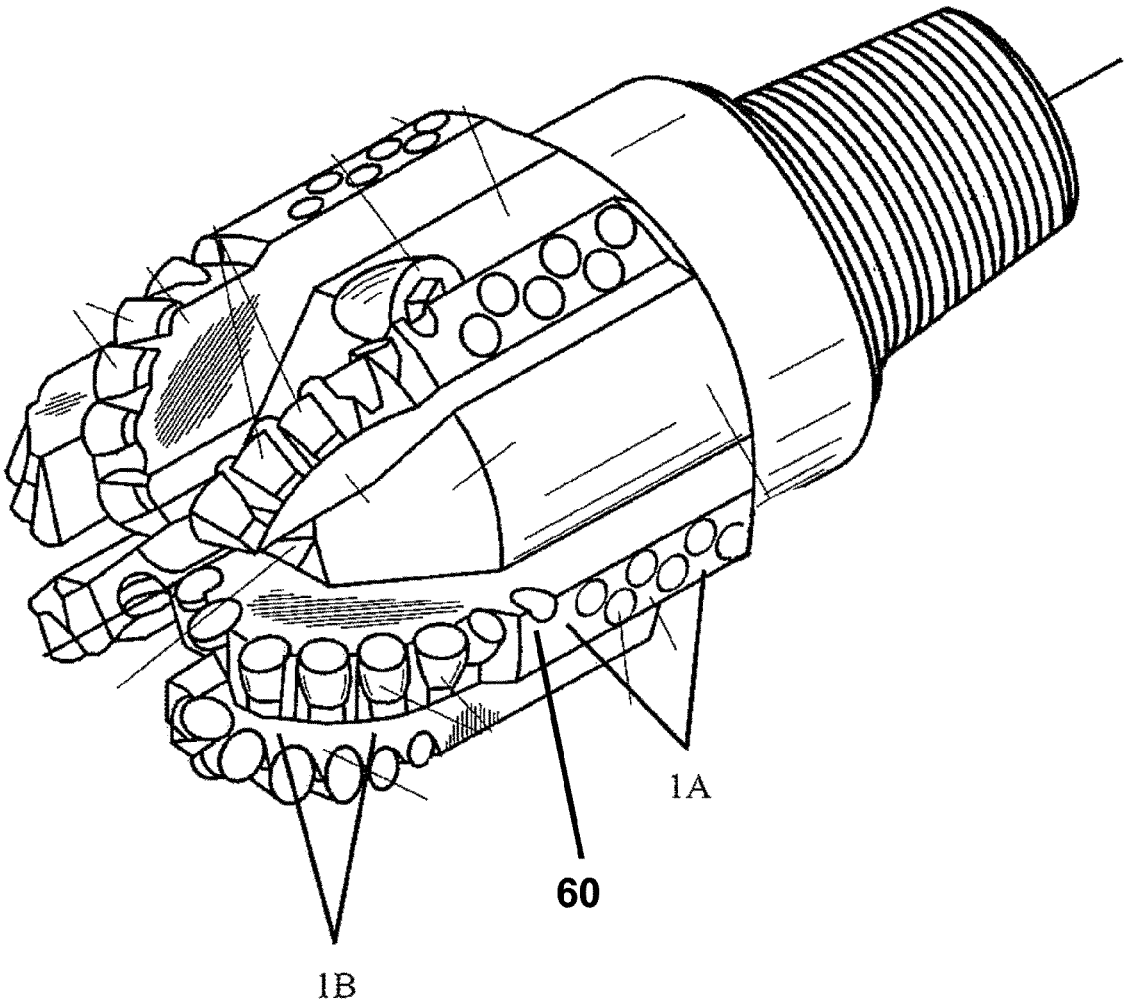
FIG. 6 is a perspective view of the bit shown in FIG. 4.
Figure 7:
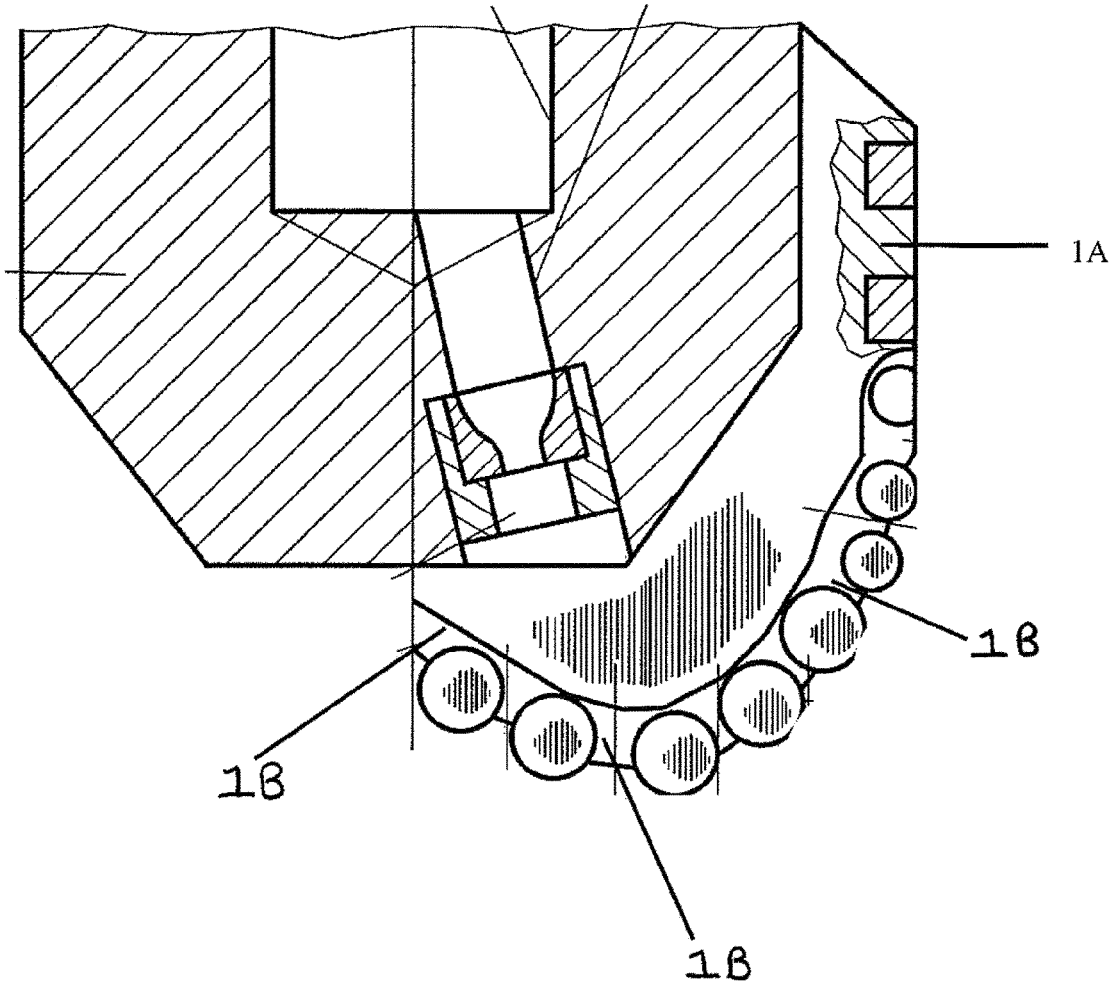
FIG. 7 is a view of one of the blades of the drill bit of FIG. 4.

In the embodiment shown, bit body 12 is formed from a composite material. Referring now to FIG. 6 and FIG. 7, bit body 12 has a gage facing surface 60, which may be hardfaced with a hard particle matrix composite. Hardfacing is applied at positions 1A and 1B and other such locations on the bit body that succumb to wear.

Embodiments herein are further drawn to a composite material comprising, a first pre-infiltrated hardphase constituent, and at least a second pre-infiltrated hardphase constituent. The second pre-infiltrated hardphase constituent is a porous carbide which comprises at least 0.5 weight % of a binder and at least about 1% porosity. The composite material also comprises an infiltrant.

Embodiments herein are further drawn to the composite material wherein the second pre-infiltrated hardphase constituent is configured to disintegrate in the infiltrant.

In some embodiments, the first pre-infiltrated hardphase constituent is selected from the group comprising titanium carbide, tantalum carbide, tungsten carbide, cemented tungsten carbides, cast tungsten carbides, sintered cemented tungsten carbide, partially sintered cemented tungsten carbide, silicon carbide, diamond, and cubic boron nitride.

In some embodiments, the first pre-infiltrated hardphase constituent is tungsten carbide. In some further embodiments the tungsten carbide may be either in the form of WC and/or $W_2C$. Tungsten carbides may comprise: spherical cast $WC/W_2C$, cast and crushed $WC/W_2C$ (irregular) and macrocrystalline WC. For hardness properties, the spherical cast $WC/W_2C$ has greater hardness than cast and crushed $WC/W_2C$, which in turn has greater hardness than macrocrystalline WC. For toughness properties, the Spherical Cast $WC/W_2C$ has a lower toughness than cast and crushed $WC/W_2C$, which in turn has a lower toughness than Macrocrystalline WC.

In some embodiments, the second pre-infiltrated hardphase constituent comprises a porous carbide, selected from the group comprising boron carbide, silicon carbide, titanium carbide, tantalum carbide, chromium carbide, vanadium carbide, zirconium carbide hafnium carbide, molybdenum carbide, niobium carbide, tungsten carbide, cemented tungsten carbide, partially sintered cemented tungsten carbide, spherical cast carbide, and crushed cast carbide. In some embodiments the second pre-infiltrated hardphase constituent is a partially sintered cemented tungsten carbide. In some embodiments the second pre-infiltrated hardphase constituent is a partially sintered cemented tungsten carbide.

In other embodiments of the composite material, the second pre-infiltrated hardphase constituent further comprises a binder. In some further embodiments the second pre-infiltrated hardphase constituent is comprised of at least 0.5 weight % of a binder. In other embodiments the second pre-infiltrated hardphase constituent is comprised of about 0.1 to about 50 weight percent of the first binder. In further embodiments the binder comprises about 15 to about 25 weight percent of the second pre-infiltrated hardphase constituent and in a further still embodiment the binder comprises about 17 weight percent of the second pre-infiltrated hardphase constituent.

In some embodiments of the composite material, the binder is at least one of: Al, B, Ni, Co, Cr, Cu, and Fe, and in some further embodiments the binder is Ni. In some embodiments of the composite material, the second pre-infiltrated hardphase constituent is 83WC-17Ni.

In some embodiments of the composite material, the second pre-infiltrated hardphase constituent comprises about 1% to about 50% porosity. In some other embodiments the second pre-infiltrated hardphase constituent comprises about 1% to about 10% porosity, and in some further embodiments the second pre-infiltrated hardphase constituent comprises about 1% to about 5% porosity. In another embodiment the second pre-infiltrated hardphase constituent comprises at least about 1% porosity.

In some embodiments, the constituents of the composite material may have a bimodal or multimodal particle size distribution. In some embodiments the first pre-infiltrated hardphase constituent has an average particle size of about 50 μm to about 1200 μm, and in some further embodiments the first pre-infiltrated hardphase constituent has an average particle size of about 300 μm to about 900 μm.

In other embodiments of the composite, the second pre-infiltrated hardphase constituent has a particle size of about <1 μm to about 300 μm. In further embodiments, the second pre-infiltrated hardphase constituent has a particle size of about 5 μm to about 100 μm, and in some further still embodiments, the second pre-infiltrated hardphase constituent has a particle size of about 15 μm to about 60 μm.

In some embodiments, the composite material comprises a third pre-infiltrated hardphase constituent. In some embodiments, a third pre-infiltrated hardphase may be further selected from the group comprising boron carbide, silicon carbide, titanium carbide, tantalum carbide, chromium carbide, vanadium carbide, zirconium carbide hafnium carbide, molybdenum carbide, niobium carbide, tungsten carbide, cemented tungsten carbide, partially sintered cemented tungsten carbide, spherical cast carbide, and crushed cast carbide.

In some instances, the third pre-infiltrated hardphase constituent has an average particle size of about 1 μm to about 500 μm. In other instances, the third pre-infiltrated hardphase constituent has an average particle size of about 1 μm to about 100 μm and in further instances the third pre-infiltrated hardphase constituent has an average particle size of about 1 μm to about 65 μm.

In other embodiments, the composite material comprises an infiltrant. In some embodiments of composite material, the infiltrant comprises at least one of Al, B, Ni, Co, Cr, Fe, and alloys thereof. In some further embodiments, the infiltrant is Co.

In other embodiments of the composite material, the first pre-infiltrated hardphase constituent comprises a first pre-infiltrated hardphase constituent binder [FPHC-binder], in some embodiments FPHC-binder comprises at least one of Al, B, Ni, Co, Cr, Fe, and alloys thereof, in some other embodiments the FPHC-binder is Co.

In other embodiments of the composite material, the third pre-infiltrated hardphase constituent comprises a third pre-infiltrated hardphase constituent binder [TPHC-binder], in some embodiments FPHC-binder comprises at least one of Al, B, Ni, Co, Cr, Fe and alloys thereof, in some other embodiments the TPHC-binder is Co.

In some embodiments, a second pre-infiltrated hardphase constituent is selected, that in comparison to the first pre-infiltrated hardphase constituent (and in some embodiments also in comparison to a third pre-infiltrated hardphase constituent) has: a small particle size, high residual porosity, and high binder content. The small particle size allows the second pre-infiltrated hardphase constituent to enter the interstitial spaces that are present between the large particles of the first, or the third pre-infiltrated hardphase constituents or combinations thereof. In some embodiments, the second pre-infiltrated hardphase constituent is a partially sintered tungsten carbide, which is particulate in structure, and comprises voids due to reduced crystal to crystal growth, and is thus porous. The partially sintered tungsten carbide also has high binder content, for example 17 weight % in 83WC-17Ni. The Ni binder is superheated on contact with a molten infiltrant. In some embodiments, the Ni binder undergoes thermal expansion which causes swelling of the second pre-infiltrated hardphase constituent. Without being limited by this or any theory, the degree of expansion is believed to be proportional to the weight percent of Ni.

As the second pre-infiltrated hardphase constituent expands and degrades after contact with the infiltrant, its particulate structure disintegrates within the infiltrant, forming a dispersion of relatively small particles among the larger particles of the first (and optionally third) pre-infiltrated hardphase constituents.

Therefore, in some embodiments, smaller more dispersed hardphase particles of pre-infiltrated hardphase are formed, and in some other embodiments, WC species are formed, each of which are directly embedded in the infiltrant. Thus, in some embodiments of the composite material, the size ratio of the second pre-infiltrated hardphase constituent before infiltration and after infiltration is 2 to 1, in other embodiments the size ratio of the second pre-infiltrated hardphase constituent before infiltration and after infiltration is at least 5 to 1, and in further embodiments the size ratio of the second pre-infiltrated hardphase constituent before infiltration and after infiltration is at least 10 to 1.

Figure 8:
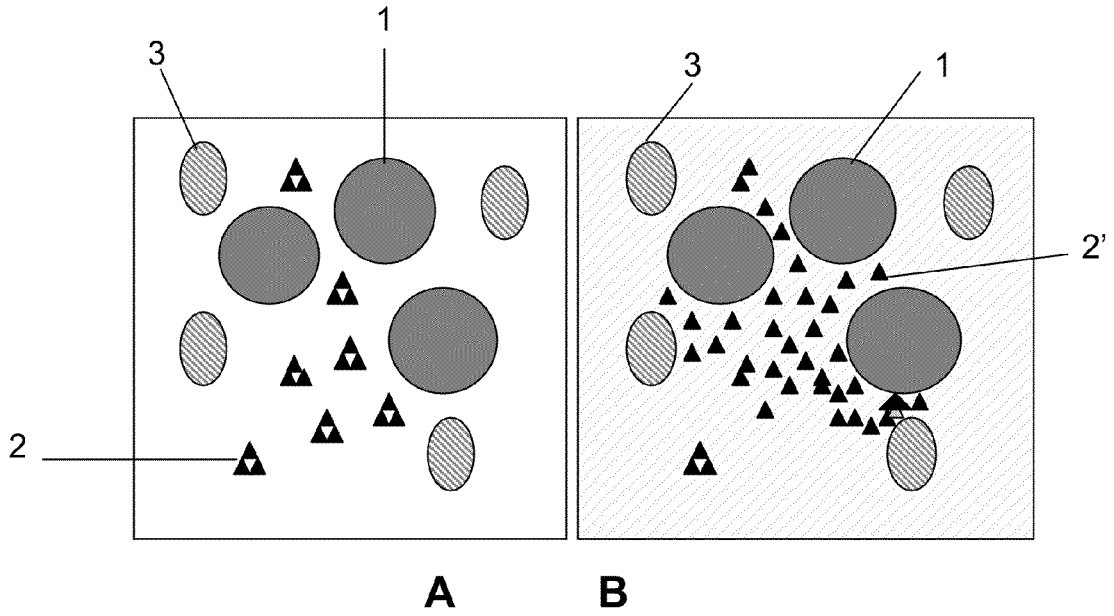
FIG. 8 depicts a representation of the hardphase constituents of a composite material prior to infiltration (A) and after infiltration (B), made in accordance with principles described herein.

These multiple hardphases (first pre-infiltrated hardhphase constituent (1), second pre-infiltrated hardphase constituent (2) and third pre-infiltrated hardphase constituent (3)) are represented before infiltration, in FIG. 8A and after infiltration in FIG. 8B. FIG. 8B depicts the dispersed species (2') formed from the second pre-infiltrated hard phase constituent (2), as they occupy interstitial spaces between the larger hardphase constituents forming a localized uniform hard phase in the matrix.

In some embodiments, a uniform hardphase dispersion are formed by the dispersed particulate 83WC-17Ni species and the larger hardphase constituents. In some embodiments a composite material with a more uniform distribution of hard particles within an infiltrant as compared to conventional hard particle matrix composites is formed and in some embodiments, the composite material imparts increased wear and erosion resistance as compared to some conventional composite matrix materials.

In some embodiments a method of making a composite material comprises, mixing: a first pre-infiltrated hardphase constituent; a second pre-infiltration hardphase constituent; Carbonyl iron powder; methylcellulose (fugitive binder); and water to form a mixture. The mixture is then loaded into a coupon mold, desiccated and cooled. Matrix powder, shoulder powder and binder infiltrant are further added to the mold, which is loaded into a preheated furnace. The infiltrant is superheated and the second pre-infiltrated hardphase constituent disintegrated in the infiltrant to form a dispersion of hardphase constituents. The dispersion is cooled to form the composite material which is further removed from the mold.

In some embodiments, desiccating comprises heating the mold at about 325° F. for about 1 hour. In other embodiments the mold is cooled to less than about 80° F. In still further embodiments superheating comprises maintaining the furnace at about 2100° F. for about 90 minutes.

In some embodiments, the composite material made by the method described herein is a matrix body bit. In some other embodiments, the composite material made by the method described herein, may be an impregnated bit body. In further embodiments, the composite material made by the methods disclosed herein, may be employed as wear or erosion resistant inserts or inlays that are applied to any wear surface of a drill bit or other earth-boring tool or device.

Some embodiments are further drawn to a drill bit for drilling a borehole in earthen formations, wherein the bit body is a composite material comprising; a first pre-infiltrant hardphase constituent; a second pre-infiltrant hardphase constituent; wherein the second pre-infiltrant hardphase constituent is a porous carbide which comprises at least 0.5 weight % of a first binder and at least 1% porosity; and an infiltrant. In some further embodiments, the second pre-infiltrated hardphase constituent is configured to disintegrate in the infiltrant. In other embodiments, the more uniform the dispersion of the total hardphase constituents within the matrix, the less preferential wear and erosion velocity of the matrix occurs, thereby prolonging the life of the bit or wear surface.

The following examples, conditions and parameters are given for the purpose of illustrating certain exemplary embodiments of the present invention.

EXAMPLES

Example 1

Production of Composite Material A

Figure 9:
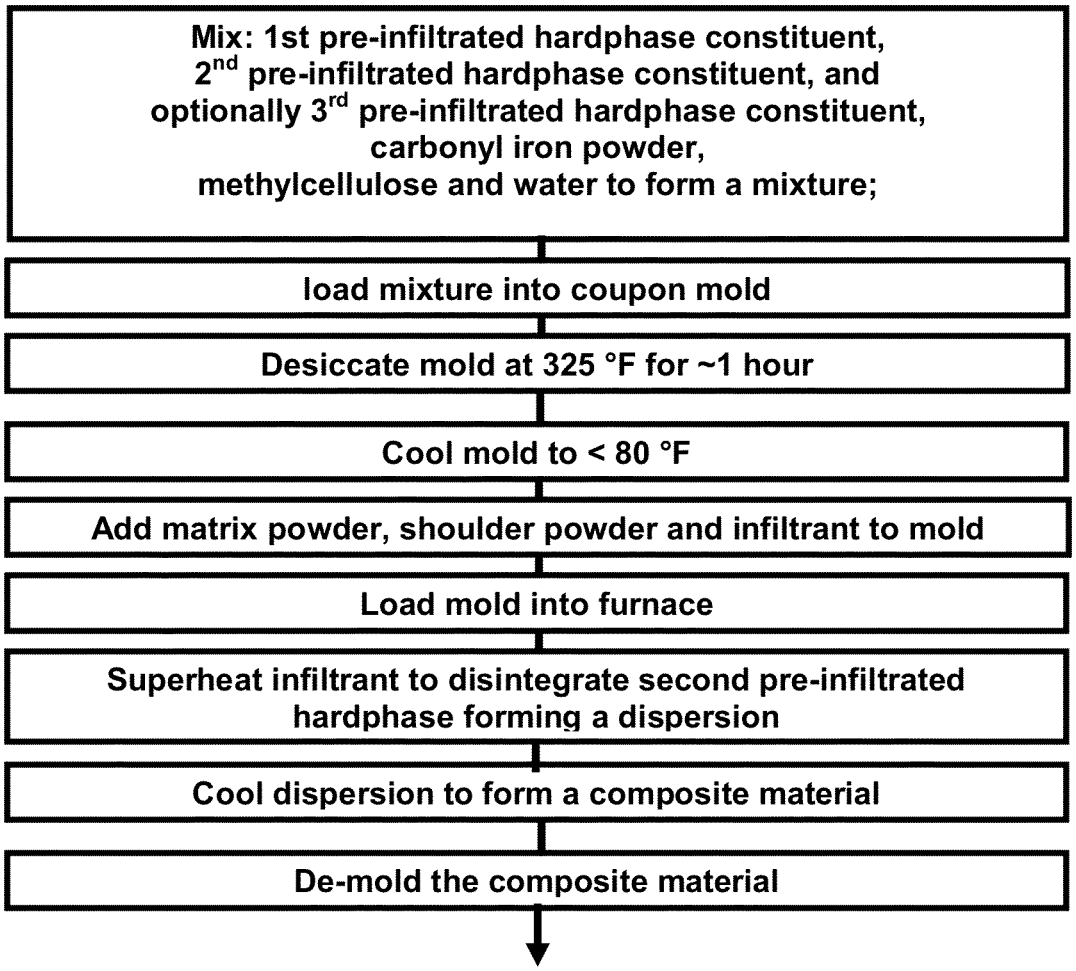
FIG. 9 depicts a process flow chart representing a method for making a hard particle matrix composite material in accordance with principles described herein.

A composite material (A) was produced by the methods described herein, and by the process depicted in FIG. 9. A first pre-infiltrated hardphase constituent (spherical cast tungsten carbide) comprising a particle size range of 500 μm to 850 μm, a second pre-infiltrated hardphase constituent (partially sintered cemented carbide WC83-17Ni), comprising particles ranging in size from 20 μm to 53 μm and a third pre-infiltrated hardphase constituent (spherical cast tungsten carbide) comprising a particle size range of 60 μm to 160 μm, were mixed with carbonyl iron powder, methylcellulose (fugitive binder) and distilled water and loaded into a coupon mold.

The mold was placed in an oven and desiccated at 325° F. for 1 hour, removed from the oven and allowed to cool to <80° F. Hard matrix powder and shoulder powder were added to the mold and packed. A Copper infiltrant alloy (powder) was further added to the mold. A furnace was preheated to 2150° F., the mold was placed in the furnace and the temperature maintained at 2100° F. for 90 minutes.

Figure 10:
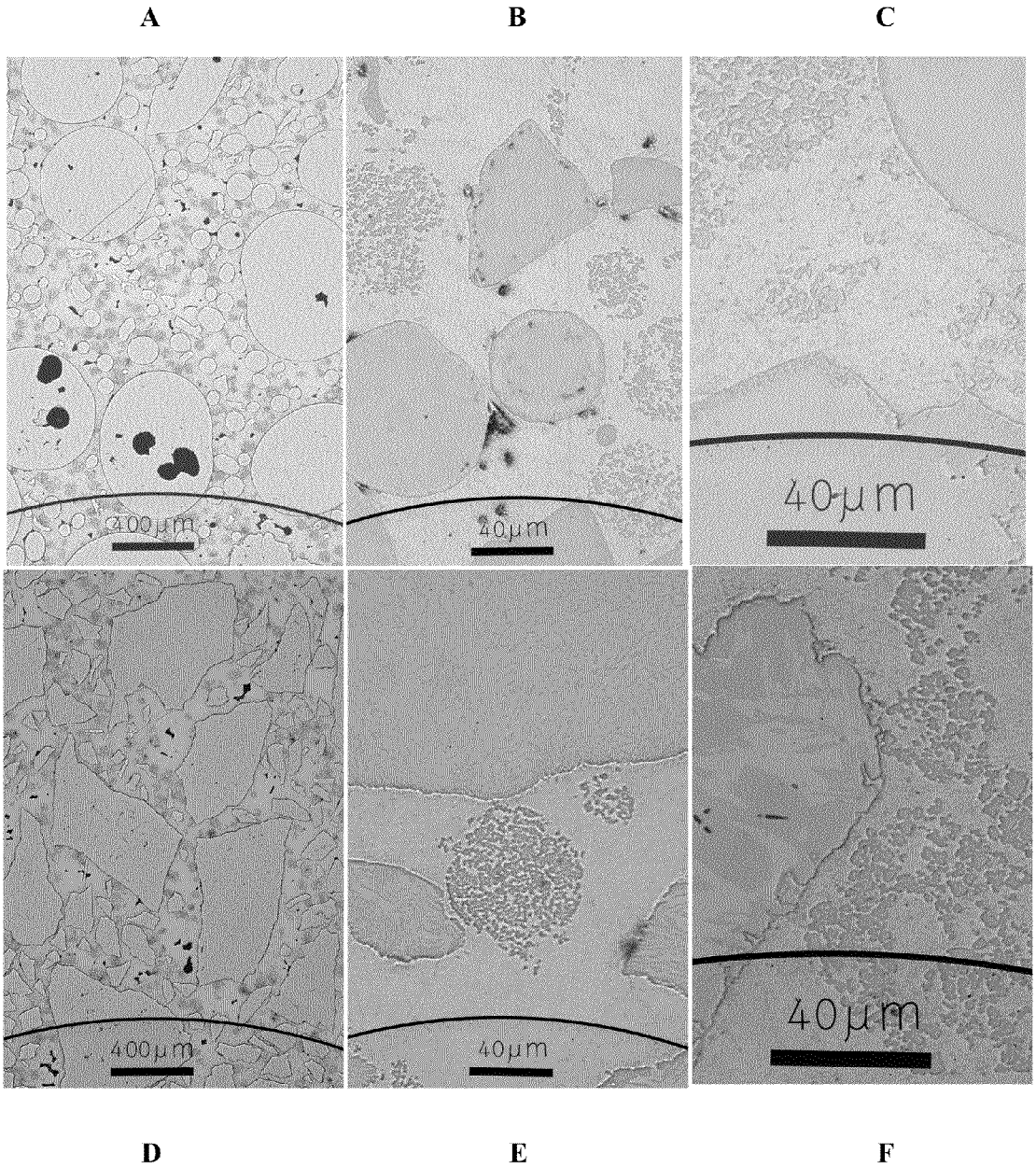
FIGS. 10A, 10B, and 10C are light photo-micrographic images at resolutions of 400 μm, 40 μm and 4 μm of a composite material comprising a first pre-infiltrated (spherical cast carbide) hardphase constituent, a second pre-infiltrated hardphase constituent (83WC-17Ni) and a third (spherical cast carbide) hardphase constituent within a binder infiltrant, made in accordance with principles described herein.
FIGS. 10D, 10E and 10F are light photomicrograph images at resolutions of 400 μm, 40 μm and 4 μm of a composite comprising a first pre-infiltrated (irregular crushed carbide) hardphase constituent, a second pre-infiltrated hardphase constituent (83WC-17Ni) and a third (irregular crushed carbide) hardphase constituent within an infiltrant, also made in accordance with principles described herein.

The mold was removed and directionally cooled using a full contact vermiculite cool. The resulting in situ dispersed composite material was then removed from the mold. The microstructure of the composite is presented in the light photomicrographs of FIGS. 10A, 10B and 10C. A trimodal distribution of post-infiltrated hardphase particles is produced, which gives a more uniform dispersion of hard particles. The second pre-infiltration hardphase constituent disintegrates within the molten infiltrant and disperses locally, and within the larger hardphases forming a more uniform hardphase within the matrix as compared with some conventional composite materials. The Vickers hardness of the composite matrix was measured and found to be 114 VHN for virgin matrix without hard particle dispersion and 335 VHN for matrix with in situ dispersed hardphase particle.

Example 2

Production of Composite Material B

A composite material (B) was produced by the methods described herein and by the process depicted in FIG. 9, whereby a first pre-infiltrated hardphase constituent of irregular crushed cast tungsten carbide comprising a particle size range of 420 μm to 840 μm, a second pre-infiltrated hardphase constituent of partially sintered cemented carbide 83WC-17Ni, comprising particles ranging in size from 20 μm to 53 μm, and a third pre-infiltration hardphase constituent of irregular crushed cast tungsten carbide comprising a particle size range of 74 μm to 177 μm, were mixed with carbonyl iron powder, methylcellulose (fugitive binder) and distilled water and loaded into a coupon mold. The mold was placed in an oven and desiccated at 325° F. for 1 hour, removed from the oven and allowed to cool to <80° F. Matrix powder was then added to the mold, the powder packed and shoulder powder added. A Cu (Copper) alloy infiltrant (powder) was further added to the mold. A furnace was preheated to 2150° F., the mold placed in the furnace and the temperature maintained at 2100° F. for 90 minutes.

The mold was removed from the furnace and directionally cooled, using a full contact vermiculite cool. The resulting in situ dispersed composite material was then removed from the mold. The microstructure of the composite is presented in the light photomicrographs of FIGS. 10D, 10E and 10F. Again a trimodal distribution of hardphases is produced, with a more uniform dispersion within the matrix. The hardness of the composite matrix was measured and found to be 174 VHN for virgin matrix without hard particle dispersion and 319 VHN for matrix with in situ dispersed hardphase particle.

Therefore it is believed that the composite materials made by the methods described herein and exemplified in Example 1 and Example 2, will impart to matrix and impregnated drill bit bodies and wear surfaces improved wear and erosion resistance as compared to some conventional composite materials, matrix and impregnated bit bodies and wear surfaces.

While preferred embodiments have been shown and described, modifications thereof can be made by one skilled in the art without departing from the scope or teachings herein. The embodiments described herein are exemplary only and are not limiting. Many variations and modifications of the methods and apparatus are possible and are within the scope of the invention. Accordingly, the scope of protection is not limited to the embodiments described herein, but is only limited by the claims that follow, the scope of which shall include all equivalents of the subject matter of the claims.

What is claimed is:

1. A composite material comprising:

a product of heating a mixture to a temperature above a melting point of an infiltrant and below a melting point of a second binder, wherein the mixture comprises:

a first pre-infiltrated hardphase constituent comprising a first porous carbide having a first binder disposed therein;

at least a second partially sintered pre-infiltrated hardphase constituent, wherein the second pre-infiltrated hardphase constituent comprises a second porous carbide and at least about 15 weight % to about 25 weight % of the second binder wherein the second pre-infiltrated hardphase constituent comprises at least about 1% porosity, wherein the second pre-infiltrated hardphase constituent has a smaller average particle size than the first pre-infiltrated hardphase constituent; and the infiltrant, wherein the melting point of the infiltrant is below the melting point of the second binder;

wherein the composite material comprises a disintegrated particulate structure of the second pre-infiltrated hardphase constituent, wherein the disintegrated particulate structure comprises a plurality of particulates formed from the disintegrated second pre-infiltrated hardphase constituent directly embedded in the infiltrant, and wherein the plurality of particulates have a size of 20% or less of the second pre-infiltrated hardphase constituent, and wherein the composite material comprises a plurality of localized uniform hard phase regions disposed within the interstitial spaces between the larger first pre-infiltrated hardphase constituent in the infiltrant, wherein the plurality of localized uniform hard phase regions are formed from the disintegrated particulate structures of the second pre-infiltrated hard phase constituent.

2. The composite material of claim 1, further comprising a third pre-infiltrated hardphase constituent.

3. The composite material of claim 1, wherein the first pre-infiltrated hardphase constituent has an average particle size of about 50 μm to about 1200 μm.

4. The composite material of claim 1, wherein the first pre-infiltrated hardphase constituent has an average particle size of about 300 μm to about 900 μm.

5. The composite material of claim 1, wherein the second pre-infiltrated hardphase constituent has a particle size of about 1 μm to about 300 μm.

6. The composite material of claim 1, wherein the second pre-infiltrated hardphase constituent has a particle size of about 5 μm to about 100 μm.

7. The composite material of claim 1, wherein the second pre-infiltrated hardphase constituent has a particle size of from about 15 μm to about 60 μm.

8. The composite material of claim 1, wherein the plurality of particulates have a size of 10% or less of the second pre-infiltrated hardphase constituent.

9. The composite material of claim 1, wherein the second pre-infiltrated hardphase constituent comprises at least one of: boron carbide, silicon carbide, titanium carbide, tantalum carbide, chromium carbide, vanadium carbide, zirconium carbide hafnium carbide, molybdenum carbide, niobium carbide, tungsten carbide, cemented tungsten carbide, partially sintered cemented tungsten carbide, spherical cast carbide, or crushed cast carbide.

10. The composite material of claim 9, wherein the second pre-infiltrated hardphase constituent is a partially sintered cemented tungsten carbide.

11. The composite material of claim 1, wherein the second pre-infiltrated hardphase constituent comprises about 17 weight percent of the second binder.

12. The composite material of claim 1, wherein the second binder comprises at least one of Al, Ni, Co, Cr, Cu, and Fe.

13. The composite material of claim 12, wherein the second binder is Ni.

14. The composite material of claim 1, wherein the second pre-infiltrated hardphase constituent is 83WC-17Ni.

15. The composite material of claim 1, wherein the infiltrant comprises at least one of Al, Co, Cr, Ni, Fe, Mn, Zn, or Cu.

16. The composite material of claim 1, wherein the first binder is selected from the group consisting of: Al, Co, Cr, Ni, Cu, and Fe.

17. The composite material of claim 16, wherein the second binder is Co.

18. The composite material of claim 1, wherein the second pre-infiltrated hardphase constituent comprises about 1% to about 50% porosity.

19. The composite material of claim 1, wherein the second pre-infiltrated hardphase constituent comprises about 1% to about 10% porosity.

20. The composite material of claim 1, wherein the second pre-infiltrated hardphase constituent comprises about 1% to about 5% porosity.

21. A composite material comprising:

a product of heating a mixture to a temperature above a melting point of an infiltrant and below a melting point of a second binder, wherein the mixture comprises:

a first pre-infiltrated hardphase constituent comprising a first porous carbide having a first binder disposed therein;

at least a second partially sintered pre-infiltrated hardphase constituent; wherein the second pre-infiltrated hardphase constituent comprises a second porous carbide and at least about 15 weight % to about 25 weight % of the second binder, wherein the second binder comprises nickel, wherein the second pre-infiltrated hardphase constituent comprises at least about 1% porosity, wherein the second pre-infiltrated hardphase constituent has a smaller average particle size than the first pre-infiltrated hardphase constituent; and the infiltrant, wherein the infiltrant comprises copper, wherein the melting point of the infiltrant is below the melting point of the second binder, wherein the composite material comprises a disintegrated particulate structure of the second pre-infiltrated hardphase constituent, wherein the disintegrated particulate structure comprises a plurality of particulates formed from the disintegrated second pre-infiltrated hardphase constituent directly embedded in the infiltrant, wherein the composite material comprises a plurality of localized uniform hard phase regions disposed within the interstitial spaces between the larger first pre-infiltrated hardphase constituent in the infiltrant, wherein the plurality of localized uniform hard phase regions are formed from the disintegrated particulate structures of the second pre-infiltrated hard phase constituent, and wherein the plurality of particulates have a size of 20% or less of the second pre-infiltrated hardphase constituent.

22. The composite material of claim 21, wherein the first pre-infiltrated hardphase constituent has an average particle size of about 300 μm to about 900 μm, and wherein the second pre-infiltrated hardphase constituent has a particle size of about 1 μm to about 300 μm.

23. The composite material of claim 21, wherein the plurality of particulates have a size of 10% or less of the second pre-infiltrated hardphase constituent.

24. The composite material of claim 21, wherein the second pre-infiltrated hardphase constituent comprises at least one of: boron carbide, silicon carbide, titanium carbide, tantalum carbide, chromium carbide, vanadium carbide, zirconium carbide hafnium carbide, molybdenum carbide, niobium carbide, tungsten carbide, cemented tungsten carbide, partially sintered cemented tungsten carbide, spherical cast carbide, or crushed cast carbide.

25. The composite material of claim 24, wherein the first pre-infiltrated hardphase constituent comprises at least one of: silicon carbide, diamond, titanium carbide, tantalum carbide, cubic boron nitride, tungsten carbide, cemented tungsten carbide, cast tungsten carbide, partially sintered cemented tungsten carbide, or sintered cemented tungsten carbide.

* * * * *